United States Patent [19]

Garbutt

[11] Patent Number: 4,468,417

[45] Date of Patent: Aug. 28, 1984

[54] PREVENTION OF METAL TARNISH

[75] Inventor: John T. Garbutt, Muscatine, Iowa

[73] Assignee: Grain Processing Corporation, Muscatine, Iowa

[21] Appl. No.: 344,216

[22] Filed: Jan. 29, 1982

[51] Int. Cl.[3] ..... B65B 33/00

[52] U.S. Cl. ..... 427/156; 106/124; 106/135; 106/136; 106/146; 106/147; 106/153; 106/154.1

[58] Field of Search ..... 106/149, 124, 136, 135, 106/138, 147, 149, 153, 154 Z, 154 R, 146, 14.13, 14.15, 14.24; 427/156, 399

[56] References Cited

U.S. PATENT DOCUMENTS

| | | | |
|---|---|---|---|
| 2,377,237 | 5/1945 | James | 106/149 |
| 2,584,123 | 2/1952 | Gruenwald | 106/149 X |
| 2,652,345 | 9/1953 | Jones | 427/384 |
| 2,849,334 | 8/1958 | Hart | 427/384 X |
| 4,224,219 | 9/1980 | Van Blanton et al. | 260/112 G |

FOREIGN PATENT DOCUMENTS

| | | | |
|---|---|---|---|
| 1040789 | 9/1966 | United Kingdom | 427/384 |

OTHER PUBLICATIONS

"Protein Protects Metals" Science News Letter, Apr. 17, 1948, p. 253.

Chemical Abstracts: vol. 90, 1979, 125,800a.

*Primary Examiner*—Thurman K. Page

*Attorney, Agent, or Firm*—Neuman, Williams, Anderson & Olson

[57] ABSTRACT

Metals are protected against tarnishing by application of a protein-containing solution to the metal surface.

2 Claims, No Drawings

PREVENTION OF METAL TARNISH

This invention relates to the surface treatment of metals to reduce tarnishing.

Metals such as silver, copper and brass are very susceptible to tarnish formation and this is generally attributed to the presence of gaseous sulfides in the atmosphere. Tarnish formation not only detracts from the appearance and beauty of the metal but also, in some instances, results in malfunction of equipment made with the metal. Various materials have been suggested for use to protect metal surfaces from tarnish. In some cases, tarnish preventatives are incorporated in and applied with a polish so as to leave a protective film on the metal surface. The protective films may be effective for relatively short periods. Polymeric materials that leave a clear film on the metal have also been suggested as tarnish preventatives. However, polymeric films tend to wear off unevenly with use leaving only part of the film intact, which may be difficult to remove when the object needs polishing and/or re-treating.

It is a major object of this invention to provide methods and compositions for treating the surfaces of metals to retard tarnishing thereof.

It is a further object of this invention to provide methods for treating metal surfaces with compositions which protect against tarnishing but which can be removed when it is desired to polish or re-treat the metal.

It is a further object of this invention to provide methods for treating metal surfaces with compositions which protect against tarnishing and which are not toxic and thus adapted for use on metal surfaces which come into contact with edibles.

These and other objects are accomplished in accordance with this invention by applying to the surface of a metal susceptible to tarnish formation a solution of a protein material. The protein material can be a protein obtained from either plant or animal sources. Protein materials suitable for use include corn protein, gelatin, casein, zein and soy protein, as well as proteins from other plant sources such as cottonseed, oats, barley, wheat and the like. A solution of the protein in an appropriate solvent such as water or alcohol is applied to a metal surface in any convenient manner such as by spraying or dipping the metal or by wiping or brushing the solution onto the metal surface. For use with metals coming into contact with foods, a protein protectant dissolved in water is preferred. For other metals, protein materials which are not water soluble, such as corn zein, can be dissolved in lower aliphatic alcohols such as methanol, isopropanol and the like.

The protein material used according to this invention can advantageously be a protein precipitate obtained as an aqueous extract of a protein source material such as corn steep liquor, soy whey, cheese whey, corn gluten filtrate, wheat steep liquor, brewer's wort and the like. Precipitation of protein from the protein-containing liquid or extract can be achieved by adding to said liquid an anionic surface active agent containing not less than 8 carbon atoms. Generally, the anionic precipitant is used in amounts ranging from about 1 to 4 grams per liter of the protein-containing liquid. Examples of anionic precipitants are alkyl aryl sulfonates, in particular alkylbenzene sulfonates in which the alkyl group contains from 8 to 20 carbon atoms, e.g. dodecylbenzene sulfonate, octadecylbenzene sulfonate, higher aliphatic sulfates and sulfonates in which the aliphatic radical comprises from 8 to 20 carbon atoms, such as lauryl sulfate, heptadecyl sulfate, lauryl sulfonate; and higher fatty acid amides in which the acyl group contains from 8 to 20 carbon atoms, such as tallow fatty acid amide, cocoa fatty acid amide and the like. The sulfonates and sulfates referred to above are commonly used in the form of alkali metal sulfonates, in particular sodium sulfonates and sodium sulfates, although the corresponding salts of ammonium or organic bases, such as, e.g. ethanol amine, triethanol amine and the like may also be used.

In a presently preferred but optional embodiment, a plasticizer is incorporated in the metal treating protein solution. The plasticizer employed is preferably a di- or polyhydroxyalkane, such as ethylene glycol, propylene glycol, glycerol, polyglycerol and other related di- or polyhydroxy compounds. Plasticizers, such as dimethylsulfoxide and ethanolamine, can likewise be employed.

As is known, corn steep liquor which is the aqueous extract obtained when corn is soaked in water containing sulfur dioxide, is a by-product of the corn wet milling industry and contains about 45–50% (dry basis) soluble protein measured as Kjeldahl nitrogen. According to one specific embodiment of the invention, an aqueous extract of corn (corn steep liquor) containing about 7 to 10 grams per liter of a filter aid material is treated with an anionic precipitant such as sodium lauryl sulfate. The pH of the corn steep liquor is maintained preferably between pH 2 and pH 6 and most preferably between pH 3.2 and pH 3.6. The sodium lauryl sulfate is used in amounts of from about 1.0 to 4.0 grams per liter of corn steep liquor. The resulting precipitate is recovered by filtration or centrifugation, washed with water (pH 4) and redissolved in dilute sodium hydroxide at a pH from about 7.0 to 10.0 and preferably between pH 7.5 to 8.5. Other alkali or alkaline salts such as ammonium hydroxide, calcium hydroxide, sodium carbonate and the like can be used in lieu of the sodium hydroxide. The protein content (Kjeldahl nitrogen X 6.25) of the solution after removal of the filter aid is preferably high, such as above about 80%, dry basis, and depends upon the level of sodium lauryl sulfate employed and the effectiveness of the washing of the precipitate. The protein precipitate can be recovered in dry form by known freeze drying or spray drying techniques.

For the protection of metals against tarnish in accordance with the invention, a 0.2 to 10% by weight, preferably 3 to 4% by weight, solution of the protein in the inorganic solvent such as water or alcohol is utilized. The tarnish retarding solution is applied in any convenient manner to coat the entire metal surface which is to be protected.

The advantages of the invention will be further apparent from the following examples. In the following examples, protection against tarnishing was determined by exposing treated metal surfaces to ambient atmosphere or to an atmosphere containing high concentrations of hydrogen sulfide which accelerates tarnishing. Under such accelerated tarnishing conditions, untreated copper generally tarnishes within about 30 minutes; silver within several hours and brass within days.

EXAMPLE 1

Four inch lengths of silver wire (silver anode wire J4-4422, from American Instrument Co.) were treated as follows. One half of the wire was dipped into the solutions described below, air dried and stored under ambient conditions. The remaining half was left untreated and served as a control. The solutions employed were:

| | |
|---|---|
| Solution A | A water solution of corn protein at pH 8.2 containing 3.7% (w/v) solids. The corn protein was prepared by treating corn steep liquor at pH 4.2 with the protein precipitant, sodium lauryl sulfate. The precipitated protein complex was recovered by filtration and redissolved by adjustment to pH 8.2. The protein content of the precipitate was 83% dry basis. |
| Solution B | Solution A plus 0.5% v/v of ethylene glycol. |
| Solution C | Solution A plus 0.5% v/v of glycerol. |

After twelve days the untreated portions had turned a light yellow color but the treated ends still retained the attractive silver appearance. After 55 days, the untreated ends were a dark brown-black color and the treated ends still had a silver appearance.

EXAMPLE 2

Lengths of silver wire (Example 1) were treated with the same solutions used in Example 1. In this example the entire wire lengths were dipped into the solutions, air dried and set in a desiccator mounted above a layer of sodium sulfhydrate. Within a short time the atmosphere in the desiccator became saturated with hydrogen sulfide. After 3.5 days the following observations were made:

| | |
|---|---|
| Control (no treatment) | Entire wire was a gold-brown color. |
| Solution A | Slightly tarnished but mostly a silver appearance. |
| Solution B | Similar to solution A results. |
| Solution C | Similar to solution A results. |

EXAMPLE 3

Strips of copper foil (1"×4") were treated on one side with the solutions described in Example 1 with the exception that additional ethylene glycol and glycerol were added to solutions B and C, respectively 1.2% v/v in each case). The solutions were applied by spreading with a flat spatula. After air drying, the strips were set in a desiccator containing sodium sulfhydrate. The results are shown below:

| | 1 Hour | 15 Hours |
|---|---|---|
| Control (No treatment) | Dark blue, red, green | Black |
| Solution A | Copper color | Copper color |
| Solution B + 1.2% Ethylene Glycol | Copper color | Copper color |
| Solution C + 1.2% Glycerol | Copper color | Copper color |

EXAMPLE 4

To determine the effect of the concentration of corn protein for the prevention of tarnish, copper strips (1"×4") were dipped in aqueous solutions (pH 8.2) of corn protein containing 0.5 to 6.2% w/v solids. After drying, the strips were placed in a desiccator containing sodium sulfhydrate. The results are shown below.

| Corn Protein (% w/v) | Time 20 Minutes | 18 Hours |
|---|---|---|
| 0 | Blue | Black |
| 6.2 | Copper color | Copper color |
| 4.8 | Copper color | Copper color |
| 3.6 | Copper color | Copper color |
| 2.4 | Copper color | Dark copper |
| 1.2 | Copper color | Blue and copper |
| 0.4 | Copper color | Blue and copper |

As seen from the above, solution concentration levels of corn protein greater than about 2.4% solids were most effective.

EXAMPLE 5

Aqueous solutions were prepared of several commercially available non-proteinaceous compounds which exhibit film-forming properties. Copper strips (½"×1") were dipped into the solutions, air dried and placed in a desiccator containing sodium sulfhydrate. The following observations were recorded.

| Solution | Concentration % w/v | Color 20 Minutes |
|---|---|---|
| Control (No treatment) | 0 | Blue-black |
| Corn Protein | 3 | Copper |
| Gum Arabic | 4 | Blue-black |
| Capsul* | 4 | Blue-black |
| Gelatin | 2 | Copper, trace blue |
| " | 1 | Copper, trace blue |
| " | 0.5 | Copper |
| " | 0.2 | Dark copper |
| Carrageenan Gum | 1.0 | Blue-black |

*Derivative of waxy maize starch manufactured by National Starch Co.

The above results show that only the corn protein and gelatin materials were effective in preventing copper tarnish whereas gum arabic, Capsul and carrageenan gum, which are not proteinaceous materials, were ineffective.

EXAMPLE 6

A 1% w/v zein solution was prepared in 85% v/v isopropyl alcohol and tested with copper foil strips by placing in a desiccator above a layer of sodium sulfhydrate. Copper strips treated with corn protein and gelatin were also tested in the same manner. The results were as follows:

| | Concentration % w/v | Time 15 Minutes | 3 Hours | 4 days |
|---|---|---|---|---|
| Control (No treatment) | 0 | Blue | Blue-Black | Black |
| Gelatin | 0.5 | Copper | Copper | "Blotchy" copper |
| Zein | 1.0 | Copper | Copper | "Blotchy" copper |

-continued

| | Concentration | Time | | |
|---|---|---|---|---|
| | % w/v | 15 Minutes | 3 Hours | 4 days |
| Corn Protein | 4.7 | Copper | Copper | "Blotchy" copper |
| Corn Protein | 2.4 | Copper | Dark Copper | "Blotchy" copper and darker |

EXAMPLE 7

Copper strips (½"×2") were dipped into a solution prepared by extraction soy flakes with water at pH 8.6 and 50°-60° C. The solution contained 5.17% w/v solids and approximately 65% protein, dry basis. After drying, the strips were set in an atmosphere of hydrogen sulfide at room temperature and their appearance observed periodically.

| | Color | |
|---|---|---|
| | 30 Minutes | 24 Hours |
| Control (No treatment) | Blue-black | Black |
| Soy Extract | Copper | Copper |

EXAMPLE 8

Copper strips (1.3×7.6 cm) were immersed in a 5% w/v solution of sodium caseinate at pH 9. After air drying, the strips were placed in a desiccator containing dry sodium sulfhydrate. Corresponding untreated copper strips were used as controls. Periodic observation of the strips showed the following results.

| | Color vs. Hours | | | |
|---|---|---|---|---|
| | 0 | 1 | 2 | 24 |
| Control | copper | dark copper | black spot | all black |
| Casein Treated | copper | copper | copper | copper |

Those modifications and equivalents which fall within the spirit of the invention are to be considered a part thereof.

What is claimed is:

1. A process for protecting a tarnish susceptible metal against tarnishing which comprises applying to said metal surface a protein-containing solution containing as a plasticizing agent a dihydroxyalkane or polyhydroxyalkane and removing solvent from said solution to deposit on the said metal surface a tarnish resistant protein coating which protects against tarnishing and maintains the original appearance of the metal surface.

2. A process for protecting a tarnish susceptible metal against tarnishing which comprises applying to said metal surface a protein-containing solution which contains protein obtained by treating a protein-containing liquid with sodium lauryl sulfate and which also contains a dihydroxyalkane or polyhydroxyalkane and removing solvent from said solution to deposit on the said metal surface a tarnish resistant protein coating which protects against tarnishing and maintains the original appearance of the metal surface.

* * * * *